US008739724B2

(12) United States Patent
Howard

(10) Patent No.: US 8,739,724 B2
(45) Date of Patent: Jun. 3, 2014

(54) INFLATABLE DRY-DOCK

(76) Inventor: Dean Richard Howard, Hollywell (AU)

( * ) Notice: Subject to any disclaimer, the term of this patent is extended or adjusted under 35 U.S.C. 154(b) by 0 days.

(21) Appl. No.: 13/463,064

(22) Filed: May 3, 2012

(65) Prior Publication Data

US 2013/0291776 A1 Nov. 7, 2013

(51) Int. Cl.
*B63B 59/00* (2006.01)

(52) U.S. Cl.
USPC ..... 114/222; 441/40

(58) Field of Classification Search
USPC ..... 114/222, 263, 221, 227; 441/40
See application file for complete search history.

(56) References Cited

U.S. PATENT DOCUMENTS

| | | | | |
|---|---|---|---|---|
| 3,296,577 | A | 1/1967 | Travis et al. | |
| 3,626,447 | A * | 12/1971 | Hindlin | 405/221 |
| 4,282,822 | A | 8/1981 | Jackson | |
| 4,385,582 | A * | 5/1983 | Fuerst | 114/227 |
| 5,549,069 | A * | 8/1996 | Faidi | 114/222 |
| 6,276,292 | B1 * | 8/2001 | Soulek | 114/222 |
| 6,477,968 | B2 * | 11/2002 | Powell | 114/46 |
| 7,047,900 | B2 * | 5/2006 | Nelson | 114/263 |
| 7,069,872 | B2 * | 7/2006 | Ostreng et al. | 114/263 |
| 7,117,809 | B2 * | 10/2006 | Lamoureux et al. | 114/263 |
| 7,302,902 | B2 * | 12/2007 | Stillman | 114/263 |
| 7,455,023 | B2 * | 11/2008 | Gerstenberger | 114/221 R |
| 7,455,024 | B2 * | 11/2008 | Barber | 114/222 |
| 7,817,055 | B1 | 10/2010 | Scanlon | |
| 7,837,526 | B1 * | 11/2010 | Doffay | 441/40 |
| 7,867,049 | B1 * | 1/2011 | Doffay | 441/40 |
| 2011/0052350 | A1 | 3/2011 | Lydle | |

FOREIGN PATENT DOCUMENTS

| | | |
|---|---|---|
| AU | 2005222514 | 4/2007 |

OTHER PUBLICATIONS

Boat Bunkers, boatbunkers.com/index.html Apr. 10, 2012.

* cited by examiner

*Primary Examiner* — Lars A Olson
*Assistant Examiner* — Jovon Hayes
(74) *Attorney, Agent, or Firm* — Dwayne E. Rogge; Schacht Law Office, Inc.

(57) ABSTRACT

The apparatus and method described herein provides a waterproof, barrier between the hull of the watercraft while the watercraft is still in the water and at a dock. In addition, the apparatus provides a resilient inflated perimeter to which further protects the hull of the vessel from accidental contact with and damage from the dock and other rigid elements which it may contact.

6 Claims, 4 Drawing Sheets

INFLATABLE DRY-DOCK

BACKGROUND OF THE DISCLOSURE

Field of the Disclosure

This application relates to the marine field of dry-docks where a marine vessel (boat) is substantially removed from contact with water, by removing the water, rather than removing the vessel.

SUMMARY OF THE DISCLOSURE

Disclosed herein is an inflatable dry-dock solution for the underside protection of pleasure (or other) watercraft from marine growth. The inflatable dry-dock in one form comprising: an inflatable perimeter float having a port side, a starboard side, and an aft side; and a malleable diaphragm sealed to the port side, starboard side, and aft side of the perimeter float to form a watertight boundary between a watercraft and the water in which the dry-dock and watercraft float. The watertight boundary in one form having an inner surface wherein the inflatable perimeter when inflated, and diaphragm in combination are less dense than water, and therefore float. The aft side of the perimeter float in one form forming a gate portion which is selectively deflated so as to be more dense than water, and therefore sink below the surface of the water in which the dry-dock floats. The gate remains attached to the perimeter float when deflated, and allows water to at least partially fill the watertight boundary such that a watercraft may enter the watertight boundary through the gate. A water pump is also provided, in fluid communication with the inner surface of the watertight boundary so as to evacuate water from between the inner surface and the watercraft.

The inflatable dry-dock as described may further include weights attached to the gate wherein the weights are significantly denser than water to help the gate to sink below the water surface.

The inflatable dry-dock disclosed may further comprise at least one pocket extension in the dry-dock diaphragm configured to accept a propeller, shaft, or rudder of the watercraft. This protects the components of the watercraft, and the dry-dock, from damage.

The inflatable dry-dock as described wherein the dry-dock perimeter tube and diaphragm are comprised of a fabric-like, waterproof material.

The inflatable dry-dock as described wherein the water pump is an automatically controlled pump, which actuates when there is a significant amount of water within the water-tight boundary adjacent the water pump. The pump may also automatically disengage when there is not a significant amount of water within the water-tight boundary adjacent the water pump.

The inflatable dry-dock as described may further comprise an automatic electric connection system comprising: a first plurality of electrically conductive leads attached to the inner surface of the watertight boundary; and a second plurality of electrically conductive leads attached to an exterior surface of the watercraft. In one form the first plurality of electrically conductive leads are in electric communication with the water pump so as to provide operating power thereto. In one form, the second plurality of electrically conductive leads are in electric communication with a power supply. Additionally, the first plurality of electrically conductive leads may be aligned with, in contact with, and in electric communication with the second plurality of electrically conductive leads when the vessel is properly parked within the inflatable dry-dock.

The inflatable dry-dock as described may be arranged wherein, the first and the second plurality of electrically conductive leads are tinned to reduce oxidation and improve electrical conduction.

The inflatable dry-dock as described may further comprise an air pump in communication with the inflatable perimeter float so as to provide positive pressure air to the inflatable perimeter float.

A method for dry docking a watercraft is also disclosed. The method comprising the steps of: providing an inflatable perimeter float having a port side, a starboard side, and an aft side; providing a dry-dock device as described, deflating the gate, positioning the watercraft into the watertight boundary through the gate; inflating the gate portion such that the perimeter float encircles the watercraft above a waterline, such that the diaphragm is in contact with the hull of the watercraft and provides a watertight boundary between the watercraft and the water in which the watercraft floats; and evacuating water from between the inner surface and the watercraft.

DESCRIPTION OF THE PREFERRED EMBODIMENTS

Figure 1:
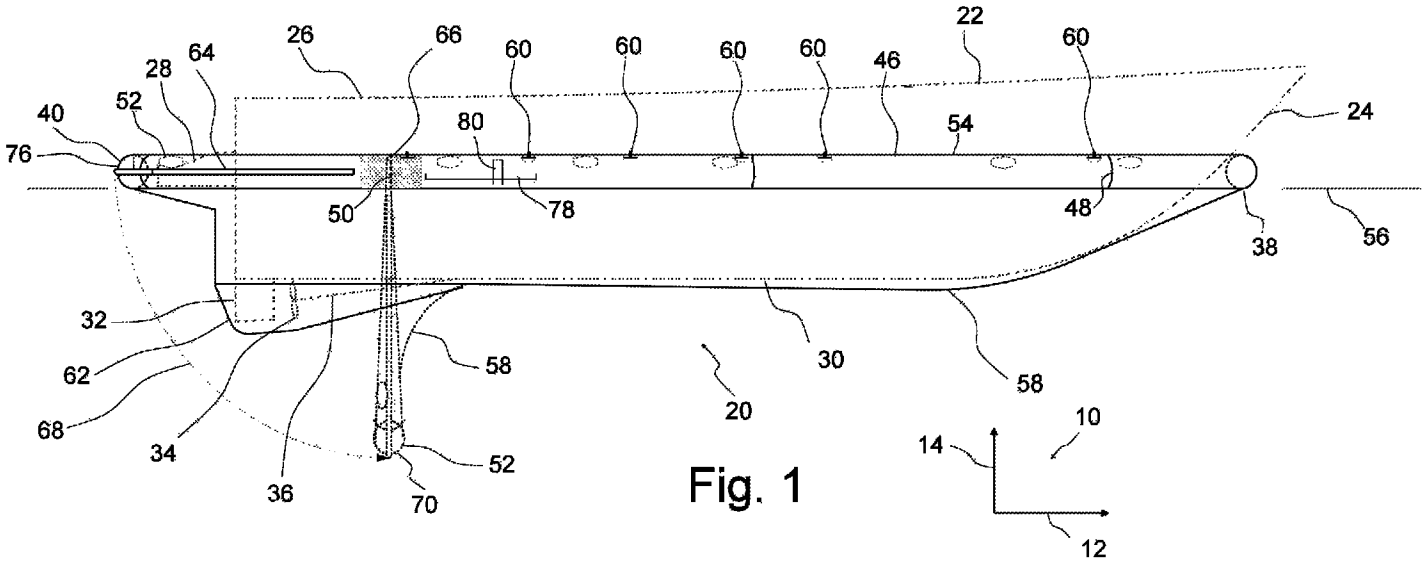
FIG. 1 is a side view of one embodiment of the disclosure where the opposing side view is substantially a mirror image thereof.
Figure 2:
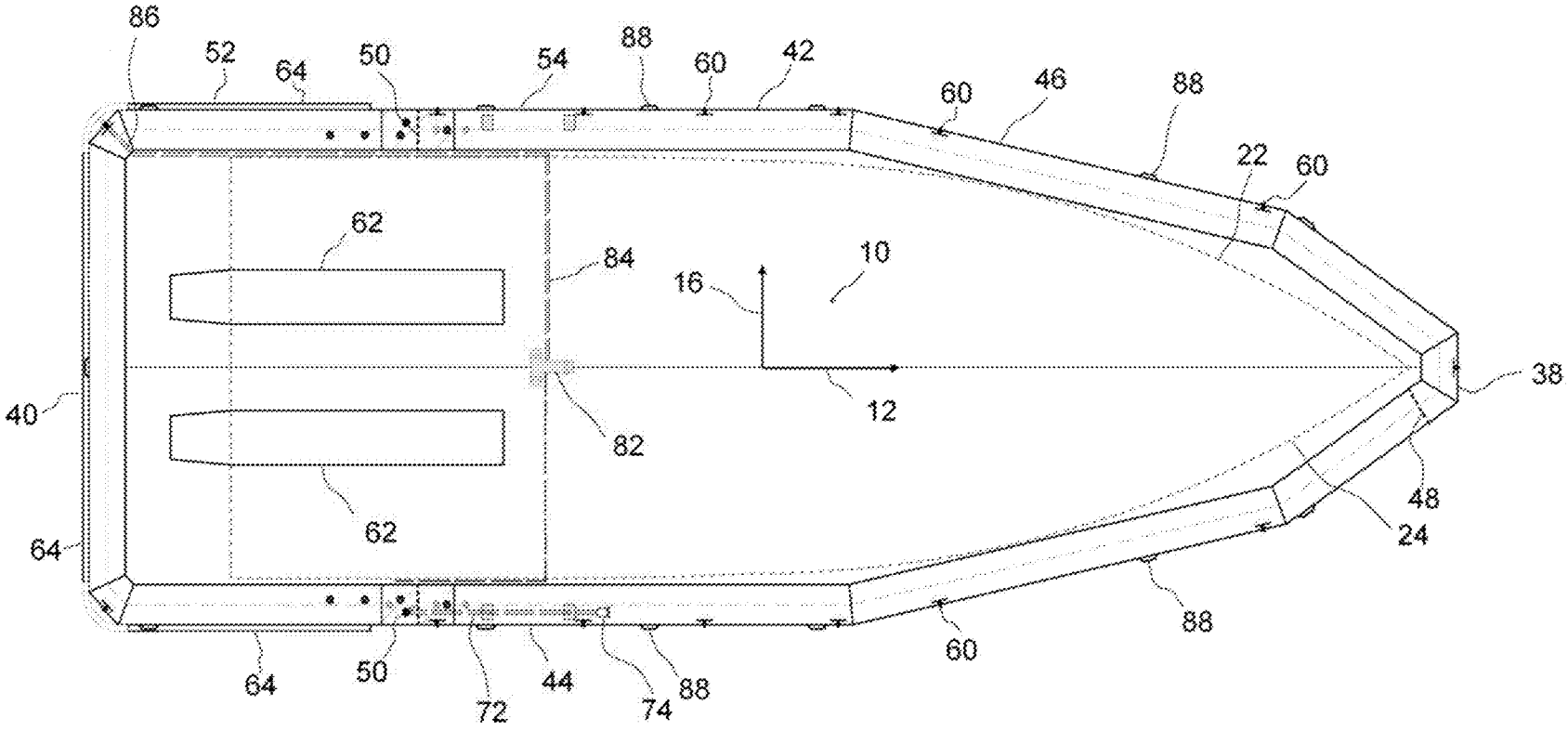
FIG. 2 is a top or plan view of the embodiment of FIG. 1.
Figure 3:
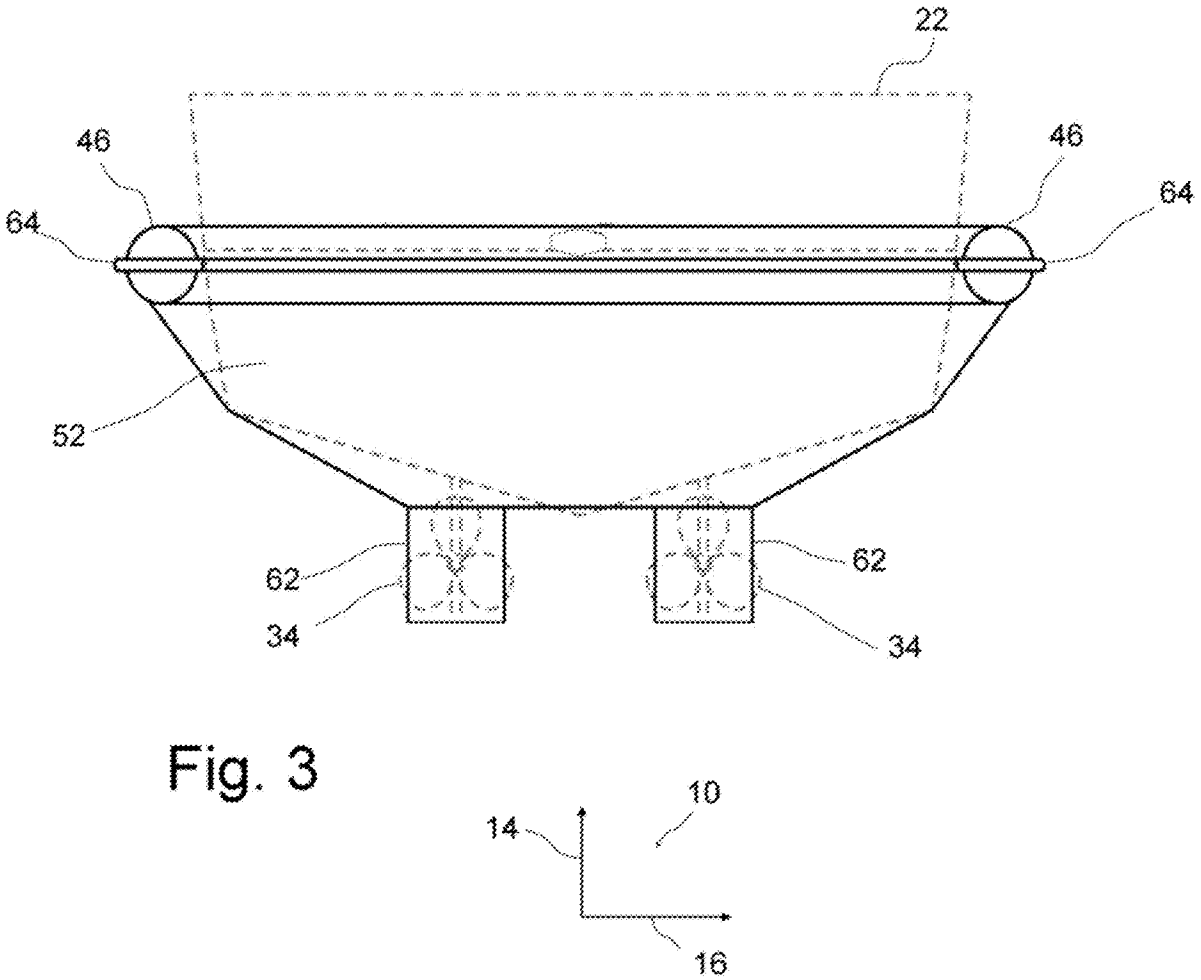
FIG. 3 is a rear view of the embodiment of FIG. 1.
Figure 4:
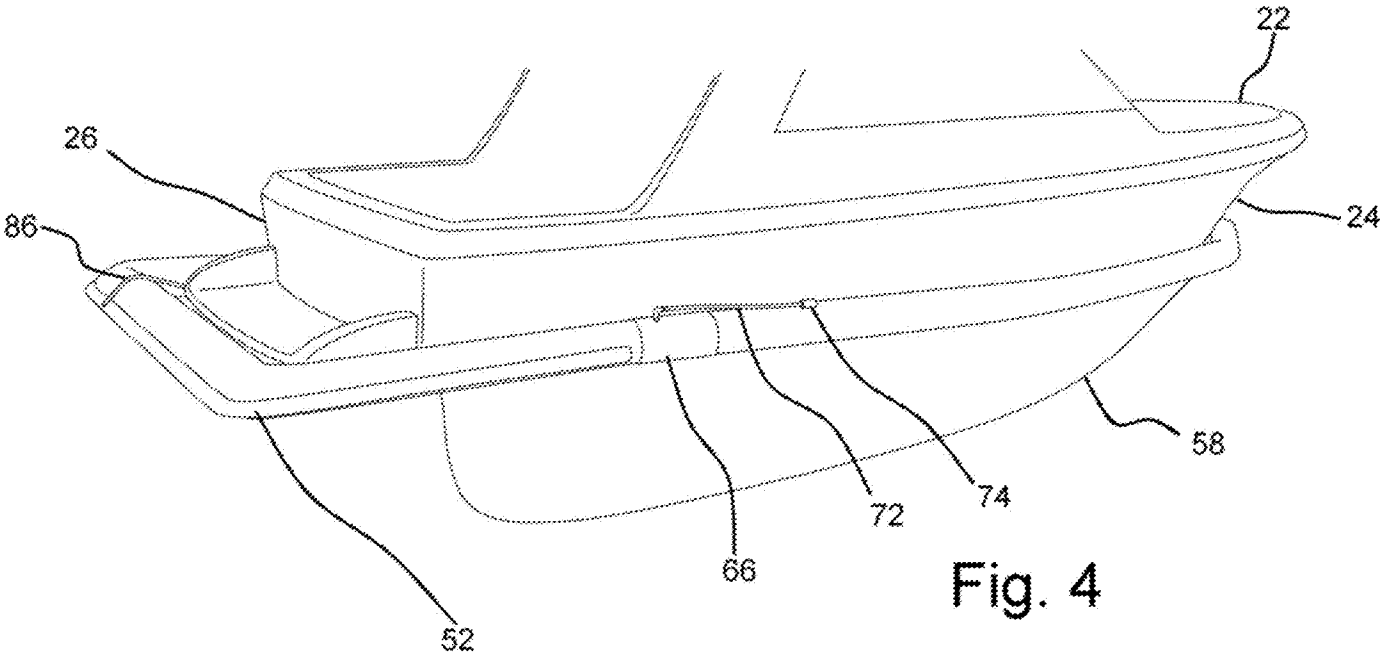
FIG. 4 is an isometric view of the embodiment of FIG. 1 with a vessel supported therein.

Before beginning a detailed description, and axes system 10 is shown in FIGS. 1, 2, and 3 generally comprising a longitudinal axis 12 which has shown points in a forward direction towards a bow portion of the apparatus, a vertical axis 14 which as shown in FIG. 1 points in an upward direction, and a transverse axis which as shown in FIG. 2 points in a left, or port side direction with the opposite direction being right or starboard. To continue with the nautical terminology used herein, the rearward longitudinal portion of the apparatus and the watercraft will be called the stern. This axes system and the directions indicated are provided for ease and understanding of the disclosure and are not intended to limit the apparatus to a particular orientation.

Generally speaking, in the field of marine moorage for watercraft (vessels) such as boats, jet skis, and similar floating vessels, it is often desired to reduce direct contact between the hull of the watercraft and the water in which the vessel floats. One obvious reason for this is to reduce any likelihood of the vessel taking on water, potentially sinking, due to a hole through the hull of the watercraft. For example, through-hull fittings periodically fail, resulting in water entry into the watercraft. If such water entry occurs when the watercraft is not occupied, or if any bilge pump fails, or if the bilge pump is inadequate to the volume of water entering the watercraft, etc., then there is a significant likelihood that the watercraft may sink or be damaged. In addition to potential water entry problems, even though the portion of the watercraft below the water line may be coated by a specific covering such as paint which is designed to retard marine growth thereupon, none of such coatings (paints) are perfect. In a saltwater environment for example, algae, fungus, barnacles, mussels, and other marine life may attach themselves to the hull of the watercraft and grow there. This growth not only is aesthetically displeasing, but also negatively impacts the performance of the watercraft in motion and results in high maintenance costs, as the vessel must be periodically removed from the water, scrubbed, and re-coated. Barnacles especially cause damage as their cement glands often permeate into the hull of the watercraft over time resulting in significant repair cost to remove, and repair the damaged portion of the hull.

Thus, where possible, watercraft are often removed from the water for storage rather than being kept at a dock in the water. This dry storage technique is often expensive and undesirable especially for larger watercraft. In addition, repositioning the watercraft from the dry storage to the water is time-consuming, potentially dangerous, and financially expensive.

The apparatus and method described herein overcomes these detriments by providing a waterproof, barrier between the hull of the watercraft, while the watercraft is still in the water and at a dock, without the use of chemicals which are detrimental to aquatic organisms. In addition, the apparatus provides a resilient inflated parameter to which further protects the hull of the vessel from accidental contact with, and damage from the dock and other rigid elements which it may contact.

Looking to FIG. 1 is shown one embodiment of a floating dry dock 20 with a watercraft 22 therein. The watercraft 22 is described as having a forward or bow portion 24, a stern portion 26 which may include a swim step 28, and a keel. Extending from the hull 30 in the illustrated embodiment of a watercraft is a rudder 32 commonly used to steer the vessel, a propeller 34, and a shaft 36 connecting the propeller to an engine normally within the watercraft 22. Power driven watercraft may also use a stern drive, or outboard engine. Other watercraft such as sailboats may not have a shaft or propeller but may be driven by sails, oars, paddlewheels, water jet drives, or similar propulsion means. There are many watercraft that have no propulsion means of their own, but rather rely on the propulsion means of other watercraft (such as tug boats) to be moved.

The dry dock 20 in one form comprises a forward or bow portion 38, and a stern portion 40 easily seen in FIG. 1. In FIG. 2, the port side 42 and starboard side 44 can be easily seen and distinguished. Looking back to FIG. 1, the dry dock 20 of this embodiment generally comprises an inflatable perimeter tube 46 which may be internally segregated at multiple points by a bulkhead 48. In one embodiment, transversely aligned bulkheads 50 within the inflatable perimeter tube distinguish a forward part 54 of the dry dock 20, which is nearly constantly inflated, from a gate portion 52, which may be selectively deflated and allowed to sink below the water line 56 to allow the watercraft 22 to enter and exit the dry dock 20. Attached and sealed to the perimeter tube 46 is a malleable diaphragm 58 which forms a watertight barrier between the outer hull 30 of the watercraft 22 and the water in which the watercraft 22 and dry dock 20 float.

The watertight diaphragm 58 may be formed of polymer impregnated fabric, polymers, watertight or water resistant fabrics or other materials commonly used in the production of inflatable watercraft such as for example polyester reinforced polyurethane. Chlorosulfonated polyethylene (CSPE) synthetic rubber (CSM) commonly sold under the trade name "Hypalon" may also be used. Other materials such as polyvinyl chloride (PVC), polyethylene, polypropylene, and other plastics or plasticized materials may be utilized in both the formation of the diaphragm 58 as well as the perimeter tube 46.

To aid in connection between the dry dock 20 and the watercraft 22, the mooring dock, pilings, another vessel, an anchor, and/or other secure mooring attachment points, a plurality of mooring beckets 60 are provided which allow attachment of mooring lines (ropes) which may then be attached between the dry dock 20 and the watercraft 22, the mooring dock, another vessel, or other apparatus to form a secure attachment between the dry dock 20 and the other apparatus. Generally, the vessel will be attached directly to the mooring dock through other mooring lines to reduce stress on the dry dock 20, although the watercraft 22 may be attached to the dry dock 20 through the mooring lines on a temporary basis while initially docking the watercraft. The mooring beckets 60 may also provide attachment points for electrical connections, fluid conduits for air entry, and water evacuation.

In addition, the diaphragm 58 may include a pocket 62, or a plurality of pockets 62, to protect and seal around the rudder(s) 32, propeller(s) 34, and/or shaft(s) 36. Similar pockets may be sized and shaped for outboard motors, sailboat keels, jet drives, and other hull projections.

In one mode of operation, the gate portion 52 may be deflated, and having a weighted portion, such as a weight tube 64 or plurality of weight tubes 64, may be heavier than water, pivot about a gate pivot 66 along pivot arc 68 as shown in FIG. 1 to an open position 70. As shown, the weight tubes 64 may be external of the gate portion of the perimeter tube, or they may be internal. In the gate open position, water may flow into the diaphragm 58, and the watercraft may be driven or pulled into the watertight boundary. Once in place, air may be pumped back into the gate portion 52 through a gate inflation hose 72 shown in FIG. 2, which may be coupled to a source of pressurized air through a disconnect fitting 74 either on the watercraft, on the moorage dock, or on (in) the dry dock 20. As the gate portion 52 is inflated, it will become lighter than water, pivot about the gate pivot 66 from the open position 70, to a closed position 76 along pivot arc 68. Bulkheads 50 assist in operation of the gate, as they maintain positive air pressure in the forward portion of the perimeter tube 46, while allowing the gate portion 52 to pivot and partially sink below the waterline 56.

In one form, a first plurality of electrically conductive leads 78 are attached to the inner surface of the watertight boundary (diaphragm 58). These electrically conductive leads are in electric communication with a water pump 82 so as to provide operating power thereto. A second plurality of electrically conductive leads 80 may be attached to an exterior surface (hull 30) of the watercraft 22, and these electrically conductive leads are in electric communication with a power supply. In this embodiment, the first plurality of electrically conductive leads are aligned, in contact with, and in electric communication with the second plurality of electrically conductive leads when the vessel is properly moored within the inflatable dry-dock. Thus, electrical power may be automatically provided to the water pump 82 without a manual connection. In other embodiments, electrical power may be provided through a standard manual plug. Manual water pumps may also be used, or the water pump may be inside the watercraft and connected by a tube or through-hull to the area between the hull 30 of the watercraft and the watertight boundary (diaphragm 58).

In one form, the water pump 82 is an automatic, bilge pump which is actuated when in contact with water, and de-activated when a certain amount (level) of water is not present.

The water pump 82 is normally connected through a tube 84 to an overboard discharge fitting 86, as shown in FIG. 2, which directs the water beyond the watertight boundary.

The source of pressurized air may be external of the perimeter tube 46, or may be provided within the perimeter tube 46. In one embodiment, an air pump (compressor) is provided within the watercraft 22 and the disconnect fitting 74 is mated to an interoperating fitting on the watercraft 22. In this way, air can be pumped into the gate portion 52 and the rest of the perimeter tube 46 without a fluid (air) connection to the mooring dock or other vessel. This also allows the apparatus to be completely portable, as it does not rely on shore power or external connections.

Once the gate portion 52 is repositioned to a closed orientation, and the watertight boundary is established around the watercraft, the pump 82 is actuated and the water between the watercraft 22 and diaphragm 58 is then evacuated. If the pump 82 is an automatic type pump, it may be left on (powered) to evacuate rainwater, water from waves splashing into the diaphragm 58 or water leaking or otherwise entering this region.

Testing has shown an unexpected benefit of the apparatus. As the perimeter tube is inflated, generally not rigid, and generally does not damage the watercraft upon entry, operators have found docking into the dry dock 20 in most instances to be easier than docking to a common rigid moorage dock, even when fenders are employed.

While the watercraft is generally not raised above a normal floating position by the dry dock, the watercraft is still protected by the perimeter tube 46, and diaphragm 58 as disclosed above.

The dry dock 20 may also comprise a plurality of handles 88, as shown in FIG. 2, for grasping such as for repositioning of the dry dock 20. The handles 88 may be especially useful in carrying the apparatus when not inflated.

While the present invention is illustrated by description of several embodiments and while the illustrative embodiments are described in detail, it is not the intention of the applicants to restrict or in any way limit the scope of the appended claims to such detail. Additional advantages and modifications within the scope of the appended claims will readily appear to those sufficed in the art. The invention in its broader aspects is therefore not limited to the specific details, representative apparatus and methods, and illustrative examples shown and described. Accordingly, departures may be made from such details without departing from the spirit or scope of applicants' general concept.

Therefore I claim:

1. An inflatable dry-dock comprising:

a. an inflatable perimeter float having a port side, a starboard side, and an aft side;

b. a malleable diaphragm sealed to the port side, starboard side, and aft side of the perimeter float to form a watertight boundary between a watercraft having a hull and the water in which the dry-dock and watercraft float;

c. the watertight boundary having an inner surface substantially conforming to the hull of the watercraft before and after evacuation of water from the watertight boundary;

d. wherein the inflatable perimeter when inflated, and diaphragm in combination are less dense than water, and therefore float;

e. the aft side of the perimeter float forming a gate portion which is selectively deflated so as to be more dense than water, and therefore sinks;

f. wherein the gate remains attached to the perimeter float when deflated, and allows water to at least partially fill the watertight boundary such that a watercraft may enter the watertight boundary through the gate;

g. a water pump in fluid communication with the inner surface of the watertight boundary so as to evacuate water from between the inner surface and the watercraft: and h. a source of pressurized air provided within the vessel;

i. a disconnect fitting coupled to the inflatable gate portion; and j. an interoperating fitting coupled to the source of pressurized air and selectively coupled to the disconnect fitting so as to allow quick and easy attachment of the source of pressurized air to the gate portion from the vessel.

2. The inflatable dry-dock as recited in claim 1 further comprising weights attached to the gate wherein the weights are significantly more dense than water.

3. The inflatable dry-dock as recited in claim 1 further comprising at least one pocket extension in the dry-dock diaphragm to accept a propeller, shaft, or rudder of the watercraft.

4. The inflatable dry-dock as recited in claim 1 wherein the water pump is an automatically controlled pump which actuates when there is a substantial amount of water within the watertight boundary adjacent the water pump, and automatically disengages when there is not a substantial amount of water within the water-tight boundary adjacent the water pump.

5. An inflatable dry-dock comprising:

a. an inflatable perimeter float having a port side, a starboard side, and an aft side;

b. a malleable diaphragm sealed to the port side, starboard side, and aft side of the perimeter float to form a watertight boundary between a watercraft and the water in which the dry-dock and watercraft float;

c. the watertight boundary having an inner surface;

d. wherein the inflatable perimeter when inflated, and diaphragm in combination are less dense than water, and therefore float;

e. the aft side of the perimeter float forming a gate portion which is selectively deflated so as to be more dense than water, and therefore sinks;

f. inflating the gate portion such that the perimeter float encircles the watercraft above a waterline, such that the diaphragm is in contact with the hull of the watercraft and provides a watertight boundary between the watercraft and the water in which the watercraft floats;

g. a water pump in fluid communication with the inner surface of the watertight boundary so as to evacuate water from between the inner surface and the watercraft;

h. a first plurality of exposed electrically conductive leads attached to the inner surface of the watertight boundary;

i. wherein the first plurality of electrically conductive leads are connected to the water pump so as to provide operating power thereto, j. a second plurality of electrically conductive leads attached to an exterior surface of the watercraft;

k. wherein the second plurality of electrically conductive leads connected to a power supply; and l. wherein the first plurality of electrically conductive leads are aligned, in contact with, and connected to the second plurality of electrically conductive leads when the vessel is fully within the inflatable dry-dock.

6. The inflatable dry-dock as recited in claim 5 wherein:

a. the first plurality of electrically conductive leads are tinned to reduce oxidation and improve electrical conduction, and b. the second plurality of electrically conductive leads are tinned to reduce oxidation and improve electrical conduction.

* * * * *